US005675936A

United States Patent [19]

Kurth et al.

[11] Patent Number: 5,675,936

[45] Date of Patent: Oct. 14, 1997

[54] REMOVABLE GUIDE ASSEMBLY

[75] Inventors: Michael J. Kurth, Howards Grove; David R. Funk, Sheboygan, both of Wis.; Joseph F. Tedescucci, Martin, Tenn.

[73] Assignee: Kohler Co., Kohler, Wis.

[21] Appl. No.: 629,255

[22] Filed: Apr. 8, 1996

[51] Int. Cl.[6] ..... E05D 15/06

[52] U.S. Cl. ..... 49/404; 49/453

[58] Field of Search ..... 49/409, 410, 411, 49/453, 454, 456, 457, 458

[56] References Cited

U.S. PATENT DOCUMENTS

| | | | |
|---|---|---|---|
| 2,978,757 | 4/1961 | Ammerman | 49/458 |
| 3,005,226 | 10/1961 | Werner | 16/93 R |
| 3,052,930 | 9/1962 | Mathews | 20/19 |
| 3,188,699 | 6/1965 | Walters | 20/19 |
| 3,514,805 | 6/1970 | Foltz | 16/90 |
| 4,228,560 | 10/1980 | Baus | 16/90 |
| 4,486,980 | 12/1984 | O'Bar | 49/411 |
| 4,688,490 | 8/1987 | Burleson | 49/411 |
| 4,769,949 | 9/1988 | Glendowne | 49/410 |

*Primary Examiner*—Anthony Knight
*Assistant Examiner*—Curtis A. Cohen
*Attorney, Agent, or Firm*—Quarles & Brady

[57] ABSTRACT

A removable guide assembly for a slidable panel which is retained in and released from a rail track for the panel by a release mechanism composed of a button-activated spring clip. The removable guide is particularly suited for use with a double panel bathing shower door and includes a guide cushion for placement between the panels. In a preferred embodiment, the removable guide assembly is connected to the rail track for the slidable panel by a hook and latch member.

19 Claims, 3 Drawing Sheets

REMOVABLE GUIDE ASSEMBLY

BACKGROUND OF THE INVENTION

A. Field Of The Invention

This invention relates to sliding panels and a guide assembly therefor. More particularly, it relates to panels which form a part of a bathing fixture such as showers and tubs wherein the guide assembly is easily removed from a rail track for the panels.

B. Description Of The Prior Art

In the design of sliding panels or doors for showers and bath tubs it is desirable to provide a guide or track member for the doors such as glass doors. Such tracks and glass doors need to be cleaned from time to time, and thus can be difficult where the track and glass doors are permanently affixed to the enclosure.

In U.S. Pat. No. 4,228,560 there is shown a lower guide mounted in the bottom of a shower door assembly which is pivotally mounted in a frame. The guide is also releasably latched through the provision of a pin and a hook shaped cut out. This provides increased access for cleaning out accumulated dirt and soap. However, the assembly is complex.

In U.S. Pat. No. 4,769,949 a free floating guide member on the door frame rides under a guide. This arrangement requires a particular rail construction as well as a difficult to clean undercut groove. Thus, a need exists for an improved panel guide assembly.

SUMMARY OF THE INVENTION

In one embodiment, the invention provides a removable guide assembly for a slidable enclosure door panel wherein a rail track slidably receives a lower portion of a panel. There is a guide member for guiding movement of the slidable panel along the track while restricting inward movement of the panel into the enclosure and a spring clip member for removably connecting the guide member to the rail track. An engagement member is operatively associated with the spring clip member. The guide member and the engagement member are constructed and arranged in conjunction with the spring clip member so that contact with the engagement member can disconnect the spring clip member from the rail track.

In one aspect a latch member engages the rail track with the spring clip member releasably accommodated therein. The latch member engages the rail track by means of a cut out portion in the rail track and slots at ends of the latch member.

In a preferred embodiment, the spring clip is connected to the guide member by a frictional engagement with the frictional engagement provided by at least one portion extending from the spring clip for engagement with the guide member.

In another aspect, the engagement member is a push button connected to the spring clip at a distance spaced from the connection of the spring clip and the push button is accommodated in a housing in the guide member.

In another preferred form, the guide member is connected to the rail track by means of a projection from the guide member extending into a downwardly open channel on the track.

In yet another preferred form, the guide member is constructed and arranged to receive two panels and the guide member includes a guide cushion connected to the guide member and positioned between the panels.

In another preferred embodiment, the rail track forms a portion of a shower door assembly.

In still another preferred embodiment, there is afforded a removable guide assembly for use with a slidable panel in a rail track wherein the rail track forms a portion of a shower door assembly.

The objects of the invention therefore include:

a. providing a removable guide assembly of the above kind for a slidable panel which affords ease of installation and removal;

b. providing a removable guide assembly of the above kind which can be easily cleaned;

c. providing a removable guide assembly of the above kind which can accommodate two panels; and d. providing a removable guide assembly of the above kind which can be produced at low cost.

These and still other objects and advantages of the invention will be apparent from the description which follows. In the detailed description below, a preferred embodiment of the invention will be described with reference to the accompanying drawings. The embodiment does not represent the full scope of the invention. Rather the invention may be employed in other embodiments. Thus, the claims should be looked to in order to judge the scope of the invention.

DESCRIPTION OF THE PREFERRED EMBODIMENT

Figure 1:
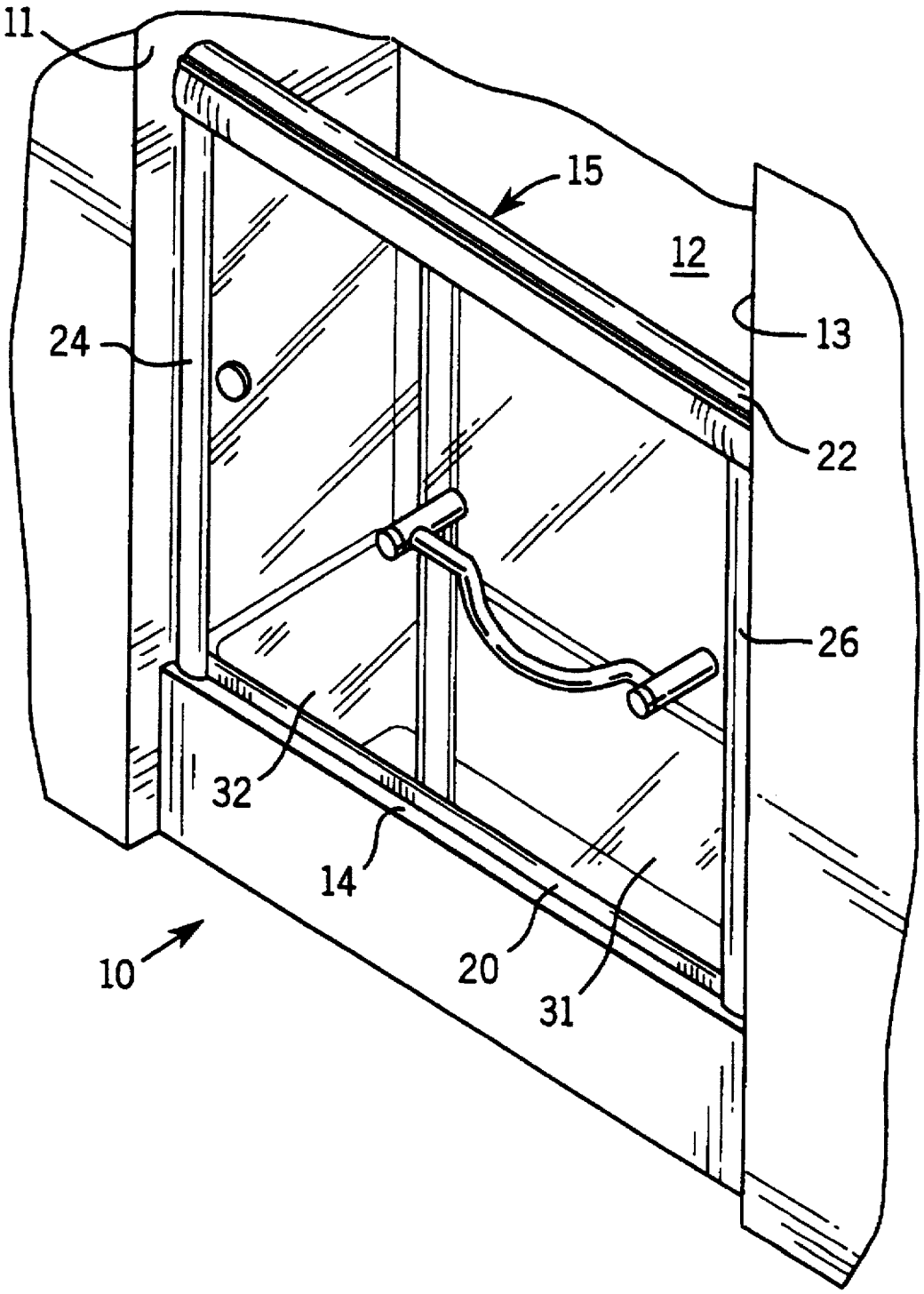
FIG. 1 is a perspective view of a shower enclosure having a sliding door system which incorporates the guide assembly of the present invention.

Referring to FIG. 1 there is shown a bath tub, generally 10, located in the recess formed by bathroom walls 11, 12 and 13. Although the present panel guide assembly is being described in the context of a bath tub, it also can be applied to showers and other enclosures. The bath tub 10 includes a front wall 14 extending between bathroom walls 11 and 13.

The tub recess above wall 14 is closed by a slidable door system, generally 15, which includes a lower track 20 mounted on the front tub wall 14 and an overhead track 22 which extends directly over the lower track between walls 11 and 13. Separate wall jams 24 and 26 are mounted vertically along each side wall 11 or 13, respectively, between the two tracks 20 and 22. The tracks 20 and 22 and wall Jams 24 and 26 define an opening of the tub enclosure.

Two glass doors or panels 31 and 32 are suspended from the overhead track 22 in the enclosure opening and extend downwardly to the front rim 14 of the tub into the lower track 20. A preferred mechanism for supporting the doors 31 and 32 in the overhead track 22 is disclosed in a commonly assigned patent application entitled, "Anti-Derailing Mechanism For Track Mounted Bath Doors", Ser. No. 08/582,859, filed Jan. 4, 1996. As an alternative, the doors can be supported at their top as in FIG. 3 of U.S. Pat. No. 4,769,949. The outer door 31 and the inner door 32 can slide in either direction past one another along the two tracks 20 and 22 to create a passageway adjacent either side wall 11 or 13 through which a bather enters and exits the bath tub 10.

Figure 2:
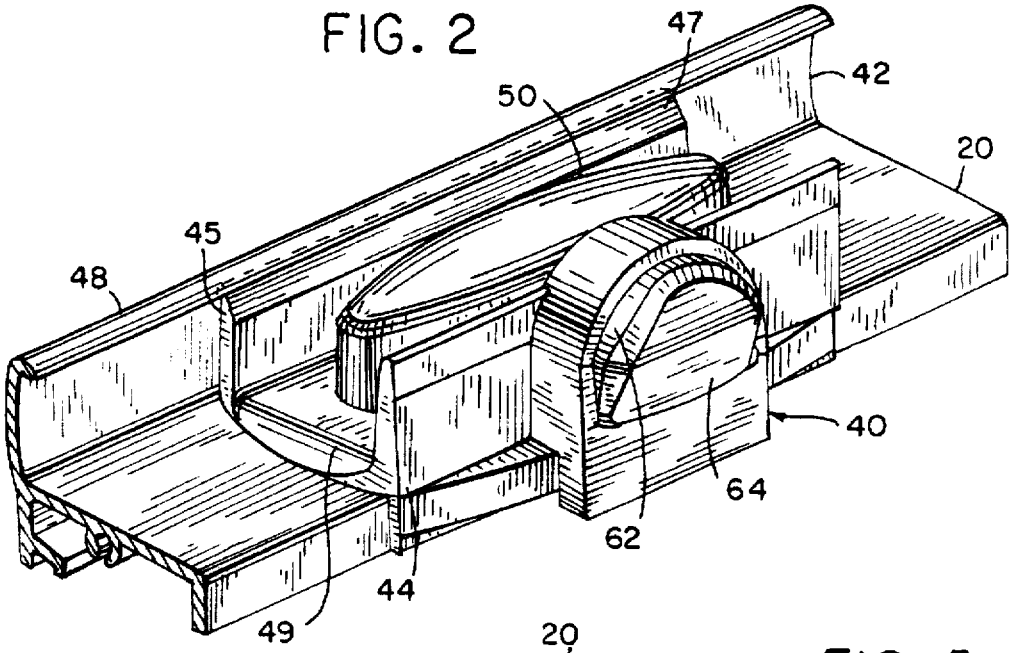
FIG. 2 is a perspective view of the guide assembly.
Figure 4:
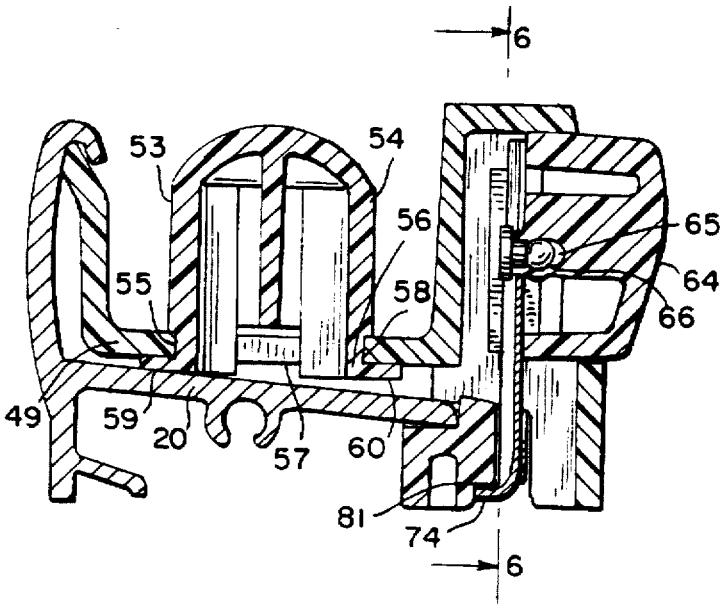
FIG. 4 is a cross sectional view of the assembly of FIG. 2.

With particular reference to FIG. 2, the removable guide assembly generally 40 would be placed on the inside of track 20. The removable guide assembly 40 includes a guide member having housing 44 with a vertical wall 45, with a bevelled edge 47 for insertion under the overhang 48 of lower track curb 42 (see FIG. 4). A guide cushion 50 is preferably centrally connected on the floor 49 of housing 44 by the projecting flaps 59 and 60 extending from the walls 53 and 54, respectively, which is seen in FIG. 4. An opening 57 is formed in the floor 49 for reception of the projecting flaps 59 and 60. The cushion is composed of a semirigid rubber material, and has reliefs as shown at 55 and 56 for engagement with floor edge 58. It is connected to the floor by pushing it up through opening 57 until the flaps 59 and 60 engage floor 49 and reliefs 55 and 56 seat against floor edge 58.

Figure 3:
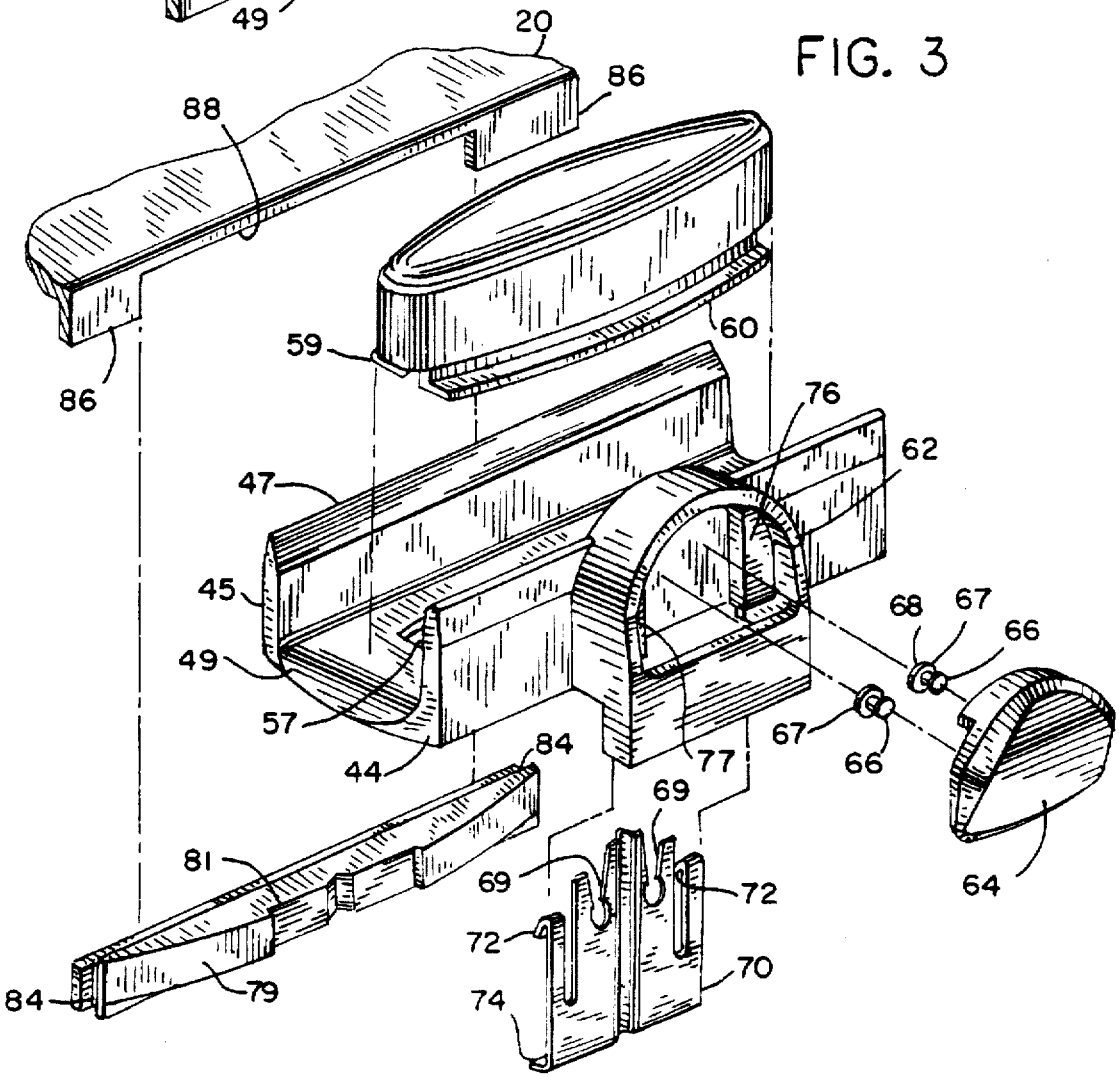
FIG. 3 is an exploded view of the component parts of the guide assembly shown in FIG. 2.
Figure 6:
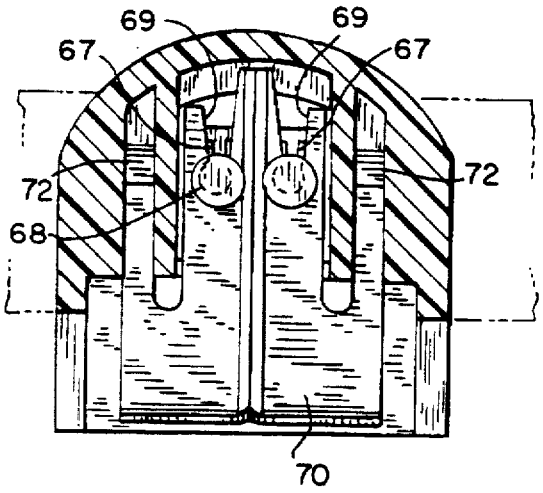
FIG. 6 is a sectional view taken along line 6—6 of FIG. 4.

As seen in FIGS. 3 and 4, the removable guide assembly is further connected to the lower track 20 by a teeter-totter spring clip 70 that is linked to a push button 64 which is accommodated in the housing compartment 62. There are the pockets such as 65 in the push button to receive the heads 66 of the rivet-like fasteners 67 which also have the shoulders 68. Slots 69 in the spring clip are positioned on the fasteners 67 between the heads 66 and the shoulders 68 for seating thereon and thus connected to the push button 64. This is also seen in FIG. 6.

It should be noted that the spring clip 70 also has the outwardly projecting fish hook portions 72 for engagement inside the spaced apart compartments 76 and 77 in the housing compartment 62. These secure the spring clip 70 in the housing compartment 62. An angled wall or projection 74 projects from the spring clip 70 for seating in the cut out 81 of the latch member 79 and for positioning thereunder. The latch member 79 is in turn interconnected to the lower track 20 by means of the cut out 88 in the track 20 and the reception of the side wall portions 86 of the track 20 into the side grooves 84 of the latch member 79.

Figure 5:
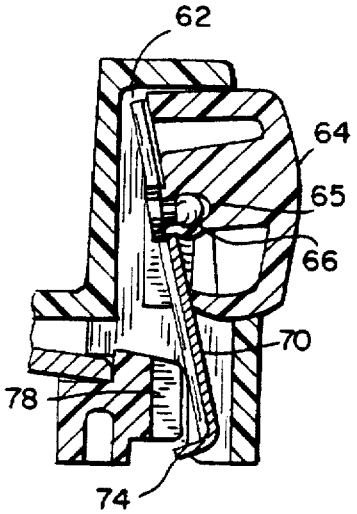
FIG. 5 is a partial cross sectional view similar to that shown in FIG. 4 with the assembly in a different mode of operations.

Referring to FIG. 5, this illustrates the release of the removable guide assembly 40 from the lower track 20 and the latch member 79. An inward movement of the push button 64 effects an inward teeter-totter movement of a top portion of the spring clip 70. This in turn causes an outward movement of the angled wall 74 as the spring clip 70 is pivoted over a section of a compartment wall 78 in the compartments such as 76 and 77. As this force is applied, the spring clip 70 is retained and secured in the compartments 76 and 77 while the angled wall 74 moves outwardly and away from the latch member 79.

Figure 7:
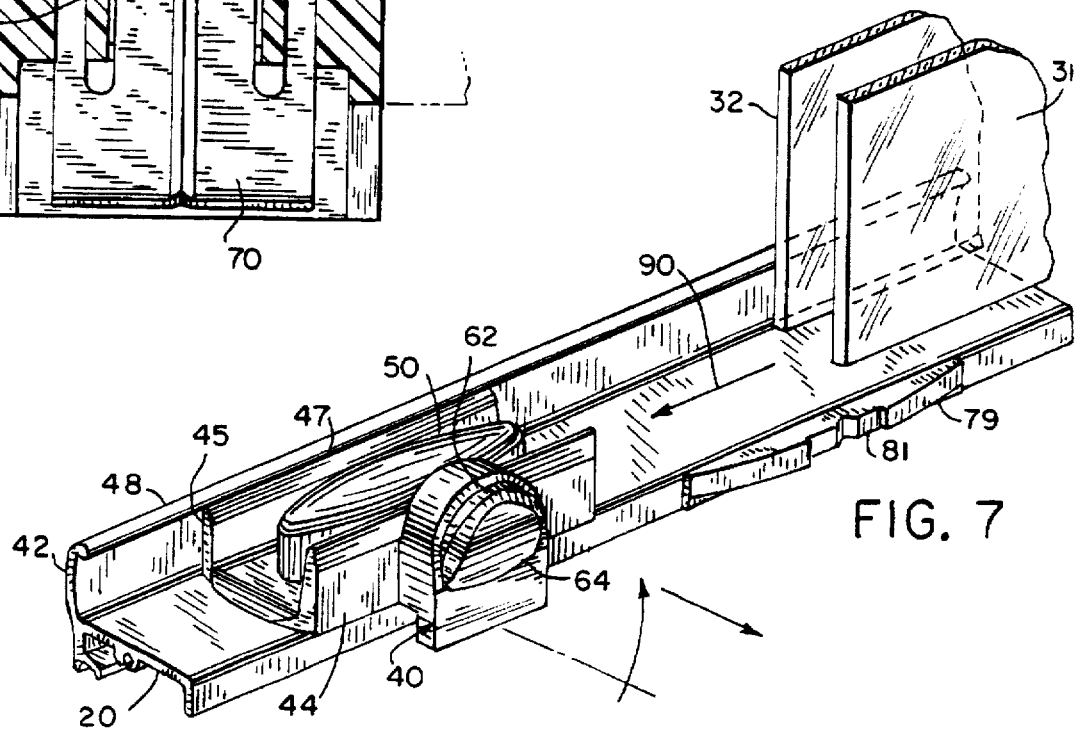
FIG. 7 is a view similar to FIG. 2, but showing the panel guide assembly in conjunction with two bathing doors.

FIG. 7 represents the movement of the guide assembly 40 and the cushion 50 from between the panels 31 and 32. This would be done when it is desired to clean the assembly and particularly the cushion 50. The shower doors 30 and 31 would be moved to a docking place to one side of the recess formed by walls 11, 12 and 13. They would be moved against the jam 24. The push button 64 would then be activated as shown in FIG. 5 with the release of the spring 70 from the latch member 79. The assembly then would be moved laterally along the lower track 20 away from the doors 31 and 32 and in the direction of the arrows 90. With the assembly 40 moved away from the latch member 79, it is then rotated upwardly as shown by the directional arrow 92 which will allow for the bevelled edge 47 to clear from under the overhang 48. The assembly is then moved away from the lower track 20 in the direction of the arrow 94. The doors are then free to swing inward into the enclosure at their bottom to expose the entire rail track 20.

In order to reassemble the guide assembly onto the track in between the doors 31 and 32, the previous procedures would be reversed.

An important feature of the removable guide assembly 40 is its facility for easy removal of the guide member for cleaning and reinsertion into the track of a shower door frame for purposes of cleaning the guide assembly with cushion 50 and the area under the doors. An advantage of the assembly is its efficient construction in that the rivet-like fasteners 67 are placed in the pockets 65 of the push button 64 without need of any special tools or equipment. Similarly, the spring 70 is connected to the fasteners 67 by a sliding action which engages the hook portion 72 in the compartments 76 and 77. It also should be noted that the latch bar member 79 is also easily assembled into the lower track 20 by frictional engagement between the grooves 84 and the side walls 86.

As stated earlier, while removable guide assembly 40 has been illustrated in conjunction with a bath tub 10, it can be applied to showers and shower doors as well as other bathing enclosures.

While a preferred embodiment has been described above, it should be readily apparent from this disclosure to those skilled in the art that a number of modifications may be made without departing from the spirit and scope of the invention. For example, in the previous description there is shown guide cushion 50 which is not intended to be removed from a housing for the assembly. If desired, it could be pushed down through the opening 57 for removal. Further, while the latch member 79 is shown as a separate component for attachment to the track 20, it could be made as a one-piece unit with the track. In addition, other means of removably activating the spring clip for detaching it from the latch bar 79 could be utilized in conjunction with the button 64 rather than the rivet-like fasteners 67. For example, a contacting surface between the push button and the spring clip could be used although this would not be as efficient. Still further, while the guide cushion 50 is of a particular submarine-like configuration, other geometric configurations could be employed such as rectangular or round, although they may not be as efficient in guiding the door panels. Still further, while the removable guide is used in conjunction with two door panels such as 31 and 32, it could be employed with a single panel.

What is claimed is:

1. A removable guide assembly for a slidable enclosure door panel comprising:

a rail track for slidably receiving a lower portion of a panel;

a guide member for guiding movement of the slidable panel along the track while restricting inward movement of the panel into the enclosure;

a spring clip member connecting the guide member to the rail track in a stationary manner with respect to the rail track; and an engagement member operatively associated with the spring clip member, the guide member and the engagement member being constructed and arranged in conjunction with the spring clip member so that contact with the engagement member disconnects the spring clip member from the rail track.

2. The removable guide assembly of claim 1, further including a latch member engaging the rail track with the spring clip member accommodated therein.

3. The removable guide assembly of claim 2, wherein the latch member engages the rail track by means of a cut out portion in the rail track and accommodating slots at ends of the latch member.

4. The removable guide assembly of claim 2 wherein the spring clip is connected to the guide member by a frictional engagement.

5. The removable guide assembly of claim 4, wherein the frictional engagement is provided by at least one portion extending from spring clip for engagement with the guide member.

6. The removable guide assembly of claim 1, wherein the engagement member is a push button connected to the spring clip.

7. The removable guide assembly of claim 6, wherein the push button is accommodated in a housing in the guide member.

8. The removable guide assembly of claim 1, wherein the guide member is connected to the rail track by means of a projection from the guide member extending into a downwardly open channel on the track.

9. The removable guide assembly of claim 1, wherein the guide member is constructed and arranged with two slots separated by a guide cushion.

10. The removable guide assembly of claim 1, wherein the rail track comprises a portion of a shower door assembly.

11. A removable guide assembly for use with a slidable enclosure door panel comprising:

a guide member for the slidable panel, the guide member being connected to a rail track;

a spring clip member connecting the guide member to the rail track in a stationary manner with respect to the rail track with the spring clip having a teeter-totter movement; and an engagement member operatively associated with the spring clip member, the spring clip member, the guide member and the engagement member being constructed and arranged so that contact with the engagement member disconnects the clip from the rail track when the guide member is connected thereto.

12. The removable guide assembly of claim 11, further including a latch member which is engageable with the rail track and the spring member being releasably accommodated therein.

13. The removable guide assembly of claim 12, wherein the latch member is engageable with the rail track by means of a cut out portion in the rail track and slots at ends of the latch member.

14. The removable guide assembly for claim 11, wherein the spring clip is connectable to the guide member by a frictional engagement.

15. The removable guide assembly of claim 14, wherein the frictional engagement is provided by at least one hook portion extending from spring clip for releasable engagement with the guide member.

16. The removable guide assembly of claim 11, wherein the engagement member is a push button connected to the spring clip member at one end of the clip member at a distance spaced from the connection of the spring clip to the rail track at the other end of the clip member.

17. The removable guide assembly of claim 16, wherein the push button is accommodated in a housing in the guide member.

18. The removable guide assembly of claim 11, wherein the guide member is connectable to the rail track by means of an angled wall member.

19. The removable guide assembly of claim 11, wherein the guide member is constructed and arranged to receive two panels and further includes a guide cushion connection to the guide member for positioning between the panels.

* * * * *